United States Patent [19]

Hipkins, Sr. et al.

[11] Patent Number: 4,655,645

[45] Date of Patent: Apr. 7, 1987

[54] METHOD AND APPARATUS FOR ANCHORING ROOF BOLTS

[75] Inventors: Edward C. Hipkins, Sr., Oakdale; Frank M. Locotos, Bridgeville; Joseph D. Comfort, Washington, all of Pa.

[73] Assignees: H&S Machine & Supply Co., Inc., Coraopolis; F. M. Locotos Co., Inc., McMurry, both of Pa.

[21] Appl. No.: 688,038

[22] Filed: Dec. 31, 1984

[51] Int. Cl.[4] ..... E21D 20/02

[52] U.S. Cl. ..... 405/261

[58] Field of Search ..... 405/259, 260, 261, 262

[56] References Cited

U.S. PATENT DOCUMENTS

| | | | |
|---|---|---|---|
| 3,108,443 | 10/1963 | Schuermann et al. | 61/45 |
| 3,222,873 | 12/1965 | Williams | 61/45 |
| 3,877,235 | 4/1975 | Hill | 61/45 B |
| 3,896,627 | 7/1975 | Brown | 61/45 B |
| 4,023,373 | 5/1977 | Hipkins | 61/45 B |
| 4,051,683 | 10/1977 | Koval | 61/45 |
| 4,122,681 | 10/1978 | Vass et al. | 405/261 |
| 4,132,080 | 1/1979 | Hansen | 405/261 |
| 4,160,614 | 7/1979 | Koval | 405/259 |
| 4,162,133 | 7/1979 | Clark et al. | 405/258 |
| 4,192,631 | 3/1980 | Vass | 405/261 |
| 4,193,715 | 3/1980 | Vass | 405/261 |
| 4,194,858 | 3/1980 | Evans | 405/259 |
| 4,299,515 | 11/1981 | Yates et al. | 405/259 |
| 4,303,354 | 12/1981 | McDowell, Jr. | 405/261 |
| 4,313,697 | 2/1982 | Rozanc | 405/261 |
| 4,386,877 | 6/1983 | McDowell, Jr. | 405/261 |
| 4,395,859 | 8/1983 | Rohrer | 405/260 X |
| 4,419,805 | 12/1983 | Calandra, Jr. | 29/458 |
| 4,477,209 | 10/1984 | Hipkins, Jr., et al. | 405/261 |

*Primary Examiner*—David H. Corbin

*Attorney, Agent, or Firm*—Webb, Burden, Robinson & Webb

[57] ABSTRACT

The anchor bolt assembly is of the type used in mine roofs and the like in which the anchor bolt assembly is positioned in a bore hole of a rock formation. The bolt assembly includes an elongated bolt shaft with a head on one end and is threaded on the other end and has a mechanical expansion anchor on the threaded end. A quick-setting resin cartridge is positioned in the bore hole above the threaded end of the bolt shaft and the bolt assembly is secured to the rock formation by both the expansion anchor and the resin. The anchor assembly includes a helical coil surrounding the bolt shaft for mixing the resin and urging it upwardly toward the threaded end while the bolt shaft is rotated in one continuous direction to secure the mechanical anchor to the rock formation. A method of anchoring such a bolt assembly is also disclosed.

6 Claims, 2 Drawing Figures

METHOD AND APPARATUS FOR ANCHORING ROOF BOLTS

BACKGROUND OF THE INVENTION (1) Field of the Invention

This invention relates to roof bolts and, more particularly, to a roof bolt which is positioned in a bore hole drilled in a rock formation in a mine roof and which is held in place within the bore hole by both a mechanical anchor and by a quick-setting resin system.

(2) Description of the Prior Art

It is a well established practice in underground mining work, such as coal mining, tunnel excavation or the like, to reinforce or support the roof of the mine to prevent rock falls or cave-ins. The most common means presently used to support a mine roof is an elongated bolt or bar which is inserted into the rock formation above the mine roof in a bore hole and which is securely fixed in the bore hole by an anchoring means such as a mechanical anchor, a quick-setting resin which surrounds the end of the bolt within the hole, or both. The roof bolt, placed under tension, is used to hold a metal support plate in close engagement with the roof.

The mechanical anchor type of roof bolt is well known and has been used for many years in supporting mine roofs. Such roof bolts typically include an elongated bolt which has a head on one end and is threaded on the opposite end. A radially expanding gripping member, referred to as an expansion shell or gripper, and an internally threaded tapered nut or spreader are placed onto the threaded end of the bolt and the downward movement of the gripper is limited by a stop mechanism such as a nut or the like. The threaded end of the bolt, along with the gripper and spreader, is placed within the bore hole drilled in the rock formation until the gripping surface on the exterior of the gripper makes contact with the rock formation. The bolt is then rotated and because the gripper is constrained from rotating, the spreader is gradually drawn downward into the gripper to cause radial expansion thereof into tightly engaged contact with the wall of the bore hole.

The use of a mechanical anchor type of roof bolt has several disadvantages. Firstly, the strength of such a roof bolt is limited due to the nature of the anchorage and will typically only hold a tension of about 12,000–16,000 lbs. In addition, it is known that the holding power of the mechanical anchor releases over time due to creep, deterioration of the rock formation surrounding the expanded gripper, and the like. This causes the gripper to slip and the tension on the bolt decreases, thereby reducing the roof support.

A more recent and generally more acceptable development has been the use of a quick-setting resin type of bolting system which permits the roof bolt to be tensioned. The use of the term "resin" is meant to include any of the resin systems, adhesive systems, cementitious systems, grouting systems and the like which are known and used in the art. Anchor bolt assemblies relying solely on a resin to mount the roof bolt within a bore hole generally include a length of reinforcing rod, also known as rebar, and an elongated bolt threadedly joined together by a two position coupling. A capsule or series of capsules containing a quick-setting resin system, such as a polyester resin and a catalyst hardener, is positioned at the blind end of the drill hole and the anchor bolt assembly is inserted into the bore hole with the rebar end adjacent the resin capsules. The anchor bolt is then further inserted and rotated so as to rupture the capsules and mix together the resin and catalyst within the bore hole. The resin system components are mixed by the knurled or textured outer surface of the rebar and the mixture quickly sets and securely bonds the rebar to the rock formation. A stop means is provided in the coupling and limits axial advancement of the bolt into the coupling and ensures that initially the entire anchor bolt rotates. After the resin has cured, further turning of the bolt releases or breaks the stop mechanism in the coupling and permits the bolt alone to be rotated and to move upwardly within the bore hole while the remainder of the anchor bolt remains rigid. Sufficient torque can be applied to tension the bolt within the bore hole. Examples of such two position anchor bolt assemblies are shown in U.S. Pat. Nos. 3,877,235; 3,896,627; 4,023,373; 4,051,683; 4,122,681; 4,132,080; 4,192,631; 4,193,715; and 4,477,209.

These resin based anchor bolt systems are much stronger than conventional mechanical anchor bolts. The resin penetrates into the surrounding rock formation to unite the rock strata and to firmly hold the bolt in position in the bore hole. The resin also fills the space between the rock formation and the bolt along a substantial portion of its length. Such a bolt starts to fail at the yield strength of the elongated bolt rod and is typically torqued to a tension of up to about one-half the yield strength.

However, these anchor bolt systems have several disadvantages. The use of a processed rebar to make contact with the resin and the use of a coupling between the rebar and bolt results in a device which is much more expensive than conventional mechanical type roof bolts. Furthermore, an additional time factor is added to the installation of such roof bolts since an operator must wait until the resin is solidly cured before the bolt can be tensioned within the bore hole.

It is also known in the art to combine a mechanical type of anchor bolt with a quick-setting resin. See, for example, the systems shown in U.S. Pat. Nos. 4,160,614; 4,162,133; 4,194,858; and 4,299,515. In these systems, the bolt is rotated in a first direction to mix the resin components and is then rotated in a second direction to draw the spreader downward and expand the gripper. A means is provided to prevent expansion of the gripper while the bolt is being rotated in the first direction. The use of a system requiring two different directions of rotation causes a discontinuity in installing a roof bolt and has an obvious disadvantage. U.S. Pat. No. 4,419,805 discloses a combination mechanical anchor and resin bolt system which permits the resin components to be mixed and the anchor to be expanded and set by a continuous rotation of the bolt in one direction. However, this system requires the use of a breakable stop device which prevents axial movement of the spreader until after the resin has begun to cure. In addition, all of these anchor bolt systems have the disadvantage that the resin components are mixed together only through the rotation of the bolt and the mechanical connector. Such a mixing action is not as thorough or complete as is desired. Furthermore, none of these systems provides a means for continuously urging the resin upwards to completely fill the space between the rock formation and the bolt. The washers provided on some of these systems (such as element 90 in U.S. Pat. No. 4,419,805, element 29 in U.S. Pat. No. 4,162,133, and element 62 in U.S. Pat. No. 4,299,515) are merely stops which keep the resin from running down along the length of the bolt from the force of gravity.

Accordingly, it is an object of the present invention to provide a method and apparatus for anchoring roof bolts which combines the features of mechanical anchors and resin bonding but also provides positive and complete mixing of the resin components by an additional mixing mechanism. It is an object to do this with a roof bolt which is reasonably inexpensive and easy to manufacture; which also forces the resin upwards along the bolt during the mixing operation; which more violently mixes the resin, resulting in a shorter mix time; and, which eliminates the use of a two position coupling or delay mechanism.

SUMMARY OF THE INVENTION

Accordingly, we have invented a roof bolt assembly which includes an elongated bolt shaft with a head on one end and threads on the other end, and with a mechanical expansion anchor on the threaded end. A quick-setting resin cartridge is positioned in the bore hole above the threaded end and the bolt assembly is positioned in the bore hole and advanced upward to rupture the resin cartridge. The anchor bolt assembly also includes a separate means external of and connected to the bolt shaft for mixing the resin and, preferably, urging the resin upwardly toward the threaded end while the bolt shaft is rotated in one continuous direction. Rotation of the bolt shaft also secures the mechanical anchor to the rock formation so that the bolt assembly is anchored by both the quick-setting resin and the mechanical anchor.

In a preferred embodiment the means for mixing the resin and urging it upward in an elongated helical coil located beneath the expansion anchor which surrounds the bolt shaft and which is connected at one end to the bolt shaft and thereby rotates simultaneously with the rotation of the bolt shaft. The bolt assembly may also include a stop means immediately below the expansion anchor and the upper end of the helical coil may be attached to the stop means. Alternatively, the upper end of the helical coil may be formed in a loop which surrounds and is affixed to the bolt shaft below the expansion anchor, such as at the lower end of the threads, to form the stop means. The lower end of the helical coil may be formed in a loop which at least partially surrounds the bolt shaft.

DESCRIPTION OF THE PREFERRED EMBODIMENT

Figure 1:
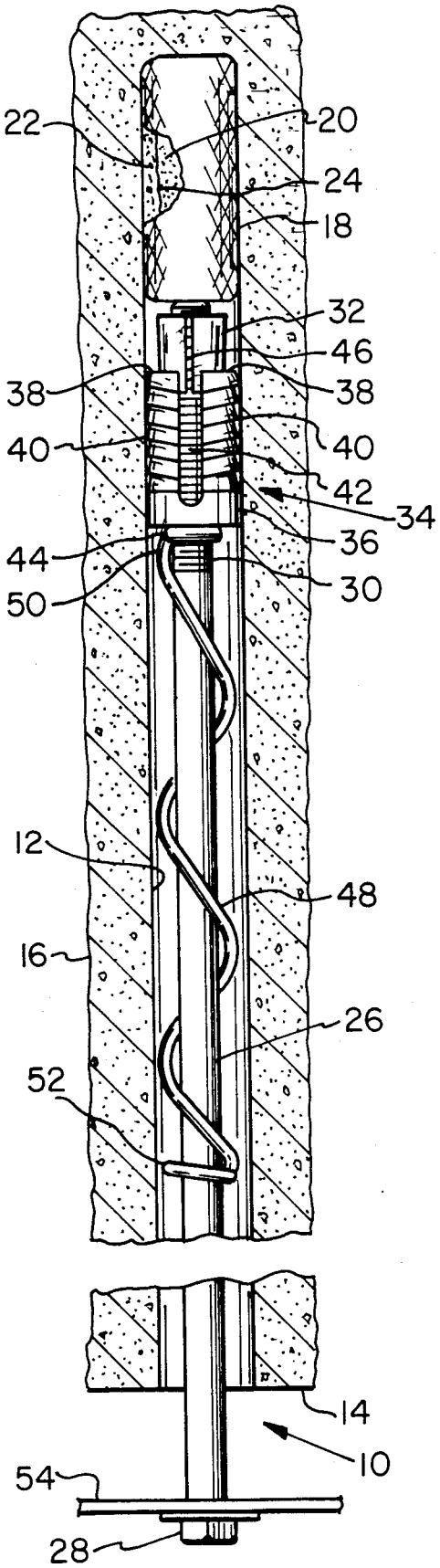
FIG. 1 is a side elevational view, partially in section, showing a rock formation having a bore hole with a roof bolt assembly in place just prior to the rupture of a resin cartridge.
Figure 2:
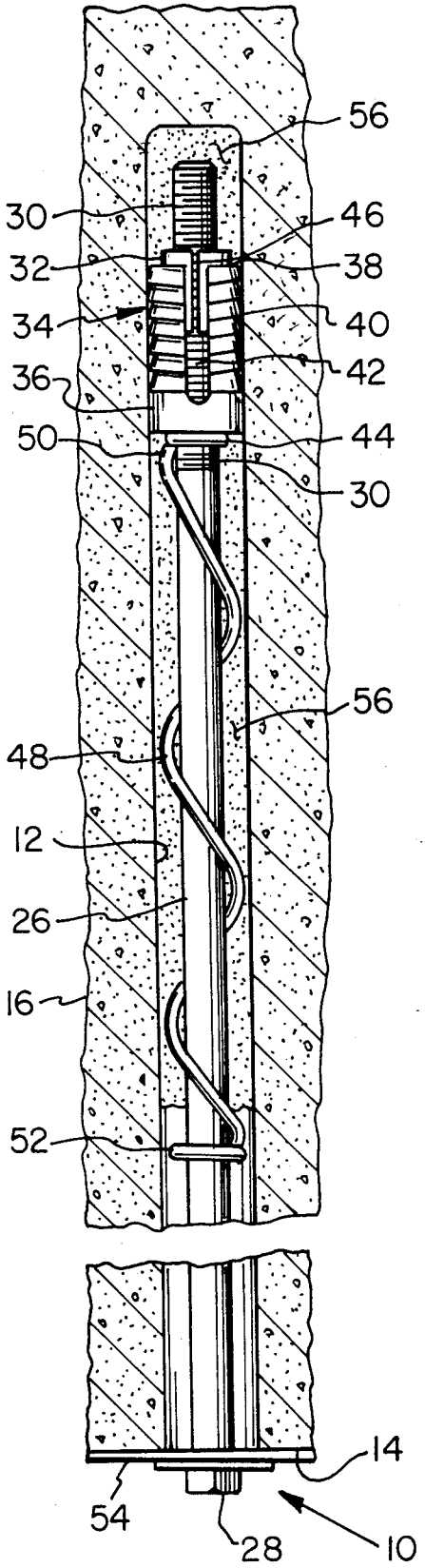
FIG. 2 is a side elevational view similar to FIG. 1 showing the roof bolt assembly as it is finally installed in the bore hole.

Referring now to FIGS. 1 and 2, there is shown a roof bolt assembly, generally designated 10, in accordance with the present invention. The roof bolt 10 is an elongated member often reaching lengths of three to eight feet or longer. The roof bolt 10 is positioned within a bore hole 12 which is drilled upwardly through a generally horizontal mine roof surface 14 and into the rock formation 16 above the mine entry.

A quick-setting resin cartridge 18 is positioned in the blind or upward end of the bore hole 12. The resin cartridge 18 is basically an enclosed, elongated tube which includes two components, an active agent 20 and a reaction agent 22 of a resin grouting mix, separated by a membrane 24. The active agent of a commonly available resin cartridge includes a polyester resin as the major component. The reaction agent is typically a catalyst or curing or hardening agent. The two components 20, 22 of the resin cartridge 18 remain in a semi-liquid or thixotropic phase until mixed, whereupon the resin begins to quickly solidify. Curing and solidification continue until an extremely strong bond is formed by the resin grout. While reference has been made to a "resin" cartridge, it is to be understood that any of the resin systems, adhesive systems, cementitious systems, grouting systems, and the like which are known and used in the art may be used in the present invention and are meant to be encompassed by the term "resin". However, resin cartridges, and in particular, polyester resin cartridges, are preferred for use with the roof bolt assembly 10.

The roof bolt assembly 10 includes an elongated bolt shaft 26 with a head 28 on one end and with threads 30 at the other end. The head 28 of a mine roof bolt is typically square rather than hex shaped. An expansion anchor comprising a tapered nut or spreader 32, having therein an internally threaded axial bore, and an expansion shell or gripping member 34, is carried on the threaded end 30 of the bolt shaft 26. The gripping member 34 is formed with a circular collar 36 at its base and with a plurality of radially expandable gripping fingers 38 extending integrally therefrom. Each gripping finger 38 is provided on its external surface with some type of gripping or engagement mechanism such as the plurality of gripping teeth 40 as shown. The gripping fingers 38 are preferably spaced apart from one another by a narrow vertical slot 42. Downward movement of the gripping member 34 is prevented by a stop 44 affixed to the bolt shaft 26 at the bottom of the threads 30 by crimping or by other means as is known in the art. The spreader 32 has a downwardly tapered configuration with an enlarged upper end and a smaller lower end. A portion of the inner surface of each gripping finger 38 abuts the tapered outer surface of the spreader 32. An elongated key 46 on the outer surface of the spreader 32 and integral therewith is positioned within a vertical slot 42 between an adjacent pair of gripping fingers 38 and helps to keep the gripping member 34 from rotating along with the spreader 32 when the bolt shaft 26 is rotated.

The anchor bolt as described hereinabove is merely one arrangement of a standard mechanical anchor type of roof bolt assembly. In accordance with the present invention, the roof bolt 10 further includes a separate mechanism connected to the roof bolt 10 for mixing the two components 20, 22 of the resin cartridge 18 after it has been ruptured. Specifically, there is shown in the Figures a helical coil 48 which is separate from and surrounds the bolt shaft 26 and extends downward immediately below the gripping member 34 in the annulus between the rock formation 16 and the bolt shaft 26. The upper end 50 of the helical coil 48 is securely connected to the bolt shaft 26, either directly or by crimping the upper end 50 to the stop 44. In a preferred embodiment, the upper end 50 of the helical coil 48 is formed in a loop which surrounds and is securely affixed to the lower end of threads 30 immediately below the gripping member 34 and said loop will itself form the stop 44. Preferably the lower end 52 of the helical coil 48 terminates in a loop surrounding the bolt shaft 26 as shown. Alternately, the lower end 52 may be affixed securely to the bolt shaft 26 or may hang freely in the annulus between the rock formation 16 and the bolt shaft 26.

The operation of the roof bolt assembly 10 in accordance with the present invention can be explained with reference to the Figures. Initially a resin cartridge 18 is placed in the bore hole 12 above the roof bolt 10 and the roof bolt 10 is advanced upwardly into the bore hole 12. FIG. 1 shows the arrangement just prior to the rupture of the resin cartridge 18. The roof bolt 10 then continues to advance into the bore hole 12 and ruptures the resin cartridge 18. At the same time, the components 20, 22 of the ruptured resin cartridge 18 are forced downward from the upward displacement of the anchor assembly.

The bolt head 28, and, hence, the entire bolt shaft 26, is rotated continuously in one direction and is drawn upward until the support plate 54 located immediately above and in contact with the head 28 comes into contact with the mine roof surface 14. The bolt head 28 typically has a width of about 1⅛ inch while the support plate may be upwards of 6 inches by 6 inches or larger. Continued rotation of the bolt head 28 will then cause the spreader 32 to move downwardly along the threads 30. This downward movement of the spreader 32 causes the gripping fingers 38 to expand radially outward and force the gripping teeth 40 into a secure engagement with the rock formation 16 surrounding the bore hole 12. Rotation of the roof bolt 10 is continued without interruption until the proper tensioning force is reached.

While the roof bolt 10 is being rotated, the helical coil 48 is simultaneously being rotated. The resin components 20, 22 are forced downwardly to the vicinity of the helical coil 48 and the action of the rotating helical coil 48 violently mixes the resin components 20, 22 together and continually urges or forces the resin components 20, 22 upwardly. It is thus ensured that the resin components 20, 22 are thoroughly mixed together and completely fill the annulus surrounding the upper portion of the roof bolt 10. The final curing of the resin to its ultimate rigid condition occurs after the rotation of the roof bolt has stopped. At least a portion of the helical coil 48 becomes embedded in the resin thus reinforcing and strengthening the resin. Ideally a substantial portion of the helical coil 48 will be embedded in the resin, but the exact proportion so embedded will depend on the size of the resin cartridge 18, the porosity of the surrounding rock formation 16 and the exact diameter of the bore hole 12 and the bolt shaft 26. The configuration of the roof bolt 10 in place with the cured resin 56 surrounding the upper part of the roof bolt 10 is shown in FIG. 2.

It can be seen that the use of the helical coil 48 for continually mixing the resin components 20, 22 provides for a stronger cured resin since it is thoroughly mixed. Furthermore, strength is added to the assembly because the resin is continually forced upward and reduces the chances of air pockets or gaps forming in the annulus between the bolt shaft 26 and the rock formation 16. Additional strengthening is added by the helical wire being embedded in the cured resin 56. Moreover, this roof bolt assembly 10 is easy to install, requiring only one continuous rotation of the bolt after it has been inserted into the bore hole 12.

Other than the resin cartridge, the roof bolt assembly of the present invention will be made entirely of metal such as iron or steel and will start to give at the yield strength of the metal bolt. For example, a ¾" diameter roof bolt was manufactured from ASTM F432-83, Grade 75 steel and was found to have a yield strength of about 31,000 lbs. A ⅝" diameter roof bolt was manufactured from the same grade of steel and found to have a yield strength of about 21,000 lbs. For a ⅝" diameter bolt it is preferable to form the helical coil from ⅛" diameter wire, while a ¾" diameter bolt would ideally have a helical coil formed from ¼" diameter wire. It will be recognized that the diameter of the helical coil will vary according to the diameter of the roof bolt and the diameter of the bore hole.

Having described presently the preferred embodiments of this invention, it is to be understood that it may be otherwise embodied within the scope of the following claims.

We claim:

1. In an anchor bolt assembly of the type used in mine roofs and the like in which the anchor bolt assembly is positioned in a bore hole of a rock formation, where the bolt assembly includes an elongated bolt shaft with a head on one end and threads on the other end, and with a mechanical expansion anchor including a spreader on the threaded end, wherein a quick-setting resin cartridge is positioned in the bore hole above the threaded end of the bolt shaft, and wherein the anchor bolt assembly is secured to the rock formation by both the expansion anchor and the quick-setting resin, the improvement comprising a stop connected to the bolt shaft immediately below said expansion anchor and an elongated helical coil having an upper end attached to said stop and positioned external of and surrounding a substantial length along the bolt shaft, said coil having a direction of coil so as to urge resin upwardly toward the threaded end while the spreader moves downwardly and while the bolt shaft is rotated in one continuous direction to achieve mixing of the resin and to secure the mechanical anchor to the rock formation.

2. The improvement of claim 1 wherein an upper end of the helical coil is formed in a loop which surrounds and is affixed to the bolt shaft immediately below said expansion anchor and forms said stop to said expansion anchor.

3. The improvement of claim 1 wherein a lower end of the helical coil is formed in a loop which at least partially surrounds the bolt shaft.

4. A method of anchoring a mechanical expansion anchor type of bolt assembly including a spreader and a stop connected to a bolt shaft below an expansion anchor in a mine roof or the like by means of the mechanical anchor and a quick-setting resin cartridge in a blind end of a bore hole comprising the steps of:

(a) providing an elongated helical coil having a direction of coil which surrounds a substantial length along the bolt shaft, and which includes an upper end attached to said stop;

(b) positioning a quick-setting resin cartridge in the blind end of the bore hole;

(c) positioning the bolt assembly within the bore hole;

(d) advancing the bolt assembly upward until the quick-setting resin cartridge is ruptured; and (e) continuously rotating the bolt shaft in one direction;

such that the rotation of the bolt shaft simultaneously moves the spreader into the expansion anchor to secure the mechanical anchor to the rock formation and thoroughly mixes the quick-setting resin and as a result of the direction of coil the coil urges the quick-setting resin upwardly toward the blind end of the bore hole.

5. The method of claim 4 wherein an upper end of the helical coil is formed in a loop which surrounds and is connected to the bolt shaft immediately below said expansion anchor and forms said stop to said expansion anchor.

6. The method of claim 4 wherein a lower end of the helical coil is formed in a loop which at least partially surrounds the bolt shaft.

* * * * *